US006733428B2

(12) United States Patent
List

(10) Patent No.: US 6,733,428 B2
(45) Date of Patent: May 11, 2004

(54) EXERCISE DEVICE

(76) Inventor: Karl A. List, 4780 La Villa Marina, #J, Marina del Rey, CA (US) 90292

( * ) Notice: Subject to any disclaimer, the term of this patent is extended or adjusted under 35 U.S.C. 154(b) by 76 days.

(21) Appl. No.: 10/087,079

(22) Filed: Mar. 1, 2002

(65) Prior Publication Data

US 2002/0151416 A1 Oct. 17, 2002

Related U.S. Application Data

(60) Provisional application No. 60/284,362, filed on Apr. 17, 2001.

(51) Int. Cl.[7] ..... A63B 23/04
(52) U.S. Cl. ..... 482/132; 482/907; 482/121
(58) Field of Search ..... 482/66, 132, 121, 482/123, 129, 907, 146, 197, 71, 51

(56) References Cited

U.S. PATENT DOCUMENTS 2,131,570 A * 9/1938 Riley
3,558,130 A * 1/1971 Anderson
3,584,871 A * 6/1971 Kelmon
3,650,528 A * 3/1972 Natterer
3,749,400 A * 7/1973 Stoffel
3,893,667 A * 7/1975 Snyder, Jr. et al.
3,911,907 A * 10/1975 Smith, Jr.

* cited by examiner

*Primary Examiner*—Jerome W. Donnelly

(57) ABSTRACT

An exercise device having a base in the form of an open-sided rectangular box and a rectangular cover for the open side having four wheels that are disposed in the base for storage, the cover being removable to serve as a movable platform during exercise. An elastic resistance band is trained around connectors in the base and exits and reenters through two holes in one side, forming an external run that is connectable to the movable platform by a hook on its underside, and two stub handles are stored in clips in the base and attachable to filling on the outside for use. Two optional disk assemblies are mountable on the base and the cover by pins that fit loosely in holes therein, and have freely rotatable top pieces that add rotational movements to the reciprocating movements of the base and the movable platform. Elastic connecting bands are provided for tying the disk assemblies together during rotation, for closed-chain exercise, and are removable for open-chain exercise. These bands also resist separation of the platforms when the first resistance band is not connected. Representative exercises of various kinds are diagrammed.

23 Claims, 5 Drawing Sheets

EXERCISE DEVICE

REFERENCE TO PRIOR PROVISIONAL APPLICATION

This application claims the benefit of copending provisional application No. 60/284,362, filed Apr. 17, 2001.

BACKGROUND OF THE INVENTION

This invention relates to exercise equipment and particularly to portable exercise devices that can be carried to selected locations and set up for use by an individual desiring to work out, typically on a supporting surface such as a floor. The invention relates more specifically to an exercise device having a component that is movable back and forth against a yieldable resistant element.

Various types of exercise devices have been designed and constructed to assist individuals in fitness programs. These range from relatively complex, heavy and expensive devices such as universal gymnasium apparatus and exercise tables such as the Pilates "Reformer" and "Performer", to small step boxes, barbells and other weights, and various kinds of strength and flexibility building equipment. Some of this equipment is stationary and some portable, and much of it is limited in use to one or a few specialized exercises.

One exercise device of the same general type as the present invention is sold by Fitter International, Inc., Calgary, Canada, under the trademark SRF Board and has a rotary disk that is mounted on a car or skate. The car is supported on an elongated track for back-and-forth movement against resistance provided by one to four elastic bands, functionally similar to the Pilates Reformer, and a second rotary disk on a fixed base that can be positioned in a selected location near the track. The disks can support a user's hands or feet and the components can be arranged in various combinations for different exercises. Another device sold by Fitter International, Inc. under the trademark VERSAFITTER comprises a four-wheeled car having two arcuate handles on its sides to be gripped by the user while pushing and pulling the car back and forth. Rotational handles on end brackets are usable for side-to-side movement and the car is strong enough to permit the user to stand or lie on it while doing various exercises. Both of these devices have proved to be satisfactory for their intended purposes and have been successful.

Other exercise devices of these general types exist, many being relative complex and cumbersome in construction and relatively expensive to manufacture. The primary objective of the present invention is to provide a new and improved exercise device of this general type that has numerous features and advantages, for increased core body strength, stability, and overall posture and for challenging the user's proprioceptive system by demanding greater neuromuscular output.

SUMMARY OF THE INVENTION

The present invention resides in a novel exercise device of the foregoing character that, at the same time, is relatively simple and inexpensive in construction and very effective and versatile in use, providing a wide variety of possible exercises. This device is capable of being made as a simple box-like unit about the size and shape of a conventional briefcase or attaché case for ease of storage and convenient portability and is very easy to set up and use, and is capable of use in numerous exercises without need for bulky weights.

For these purposes, the presently preferred embodiment comprises a stationary platform or base in the form of an open-sided box and stationary platform that serves as a cover for the open side, having wheels on one side to support the movable platform. The wheels fit within the box when the movable platform is in place as a cover. An elastic resistance band is anchored within the box and is connectable to the movable platform when the two primary components are in side-by-side relation, and the band is adjustable for varied resistance levels simply by changing its anchor pattern within the box. Stub handles normally are stored within the box and are attachable to fittings on the outer sides of the box for use. Easily releasable latches normally hold the device closed, and a carrying handle is provided on one side of the box for convenient briefcase-like carrying. The base provides a very stable stationary platform and the trackless movable platform enhances the development of balance and biomechanical efficiency while eliminating reliance on ground contact and brute force.

The preferred elastic resistance element is an elongated, flexible elastic band that is stretched around connections in the box to set the desired tension, one length of the band being stretched across the outer side of one sidewall of the box between two exit holes, preferably on the side of the box opposite the carrying handle, to be attached to a connection on the underside of the movable platform. The connections preferably are hooks set into the material of the box and the movable platform, which may be constructed of wood panels or other suitable material, including plastic or metal. This permits changing of the band if a different range of resistance values is desired. Accessories that can be used with the basic device include a resilient "pull" member for use with an anchor such as an adjacent wall, and a second resistance element of different strength for variation of the resistance levels.

For a unique combination of different beneficial exercises, two disk assemblies that are additional accessories to the basic device are rotatably mountable on top of the box and on the movable platform for rotary motion of the user's body parts while using the reciprocating motion of the two platforms. In the preferred embodiment, these disks are attachable to the basic device through simple depending pins that are received in holes in the top surfaces of the two platforms, and have releasable connections for elongated connectors that tie the two disks together for "closed chain" exercises and are removable to adapt the disks for more advanced "open chain" exercises after the user has progressed through the easier open-chain exercises. These connectors are resistance bands that cause the disks to turn together and incidentally add resistance to turning in the higher end of the range of motion.

Other aspects and advantages of the invention will become apparent from the following detailed description, taken in conjunction with the accompanying drawings.

DETAILED DESCRIPTION

Figure 2:
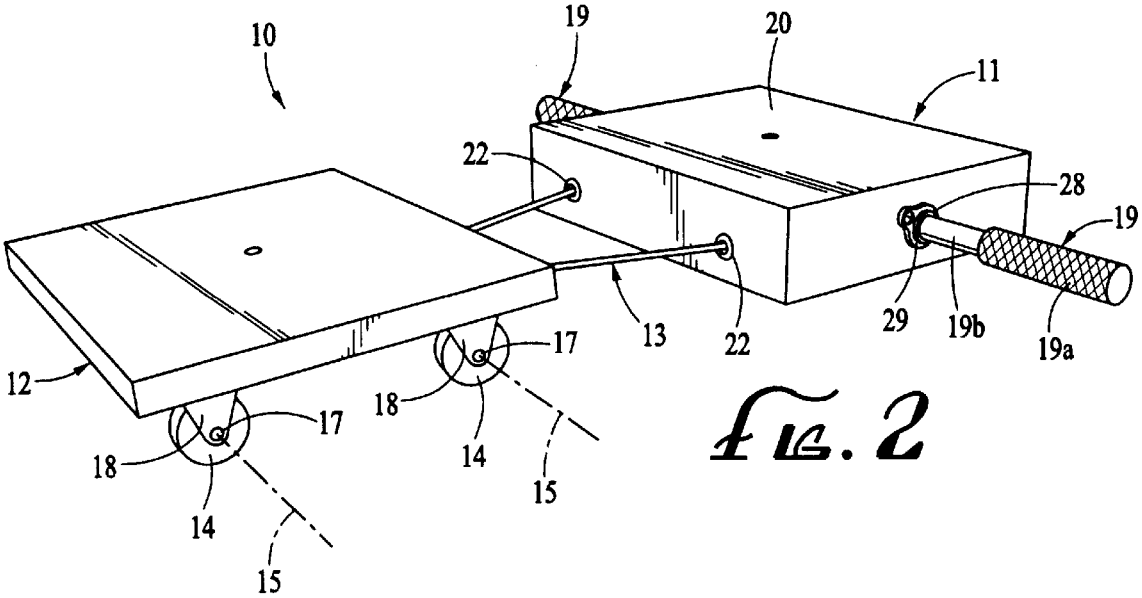
FIG. 2 is a top perspective view of the exercise device shown in FIG. 1, in the open condition and separated during use, with the cover/movable platform removed from the box and connected by the resistance band, and the stub handles removed from the box and attached to the outer sides for use.

As shown in the drawings for purposes of illustration, the invention is embodied in an exercise device, indicated generally by the reference number 10, basically comprising a stationary base, indicated generally at 11, and a movable platform or car, indicated generally at 12. In the condition shown in FIG. 2, the car is joined to the stationary platform by a resiliently flexible resistance element 13 which yieldably resists movement of the movable platform away from the stationary platform during basic exercises for which the device is used.

Roller-type wheels 14 are rotatably mounted on the underside of the movable platform, herein one beneath each corner, to rotate about axes 15 (FIG. 2) that are defined by axles 17 on brackets 18 supporting the wheels. Two detachable stub handles 19 are fixed to opposite sides of the stationary platform, generally parallel to the axes 15 of the wheels, to be gripped by the hands of a user, as will be seen in connection with representative exercises.

Figure 1:
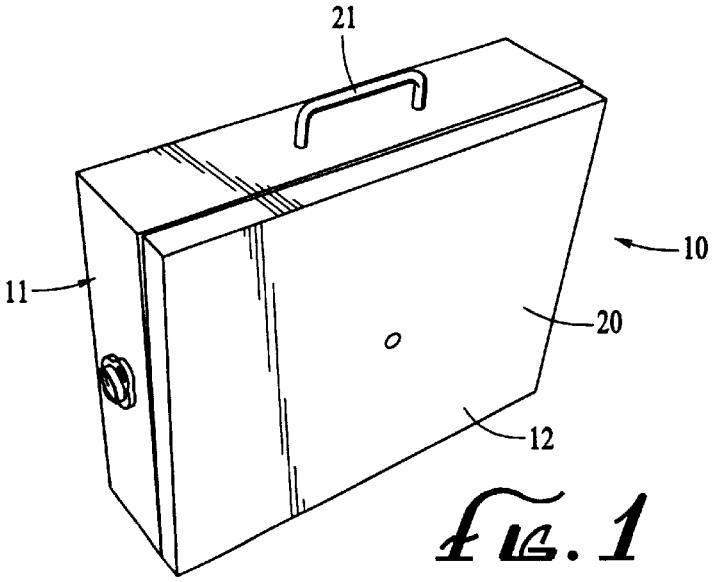
FIG. 1 is a side perspective view of the basic exercise device in accordance with the present invention, shown in the closed position used during storage and transportation of the device.

In accordance with the present invention, the exercise device 10 is designed and constructed to be effective for use in a wide variety of highly beneficial exercises while, at the same time, being capable of assembly in a compact and convenient unit for transportation and storage. For these purposes, the stationary base 11 is an open-sided rectangular box having a substantially flat side 20 forming the upper side during use, and the movable platform 12 is a rectangular plate or board that fits over and covers the open side of the box with the wheels 14 stored inside, as shown in FIG. 1. The other elements of the basic device 10 are stored inside as well, and the movable platform is conveniently held in place by releasable latches that can be seen in FIGS. 3 and 4. A U-shaped carrying handle 21 on one side permits carrying of the unit much like a briefcase.

Figure 3:
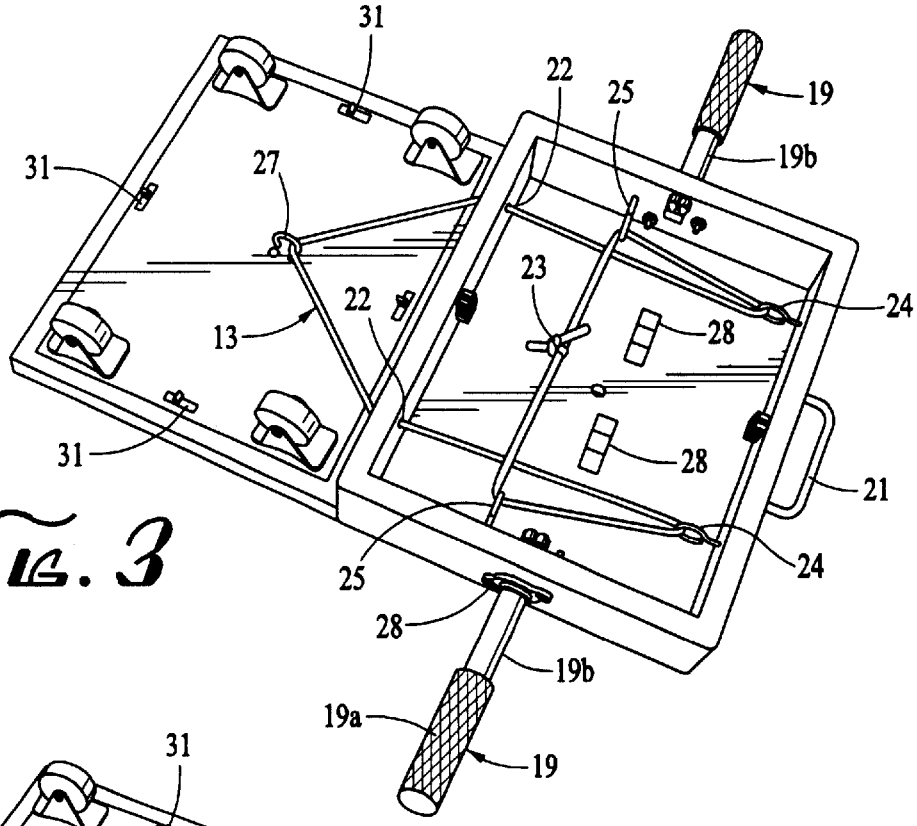
FIG. 3 is a bottom perspective view of the exercise device of FIG. 2 with the movable platform and the box in side-by-side relation.
Figure 4:
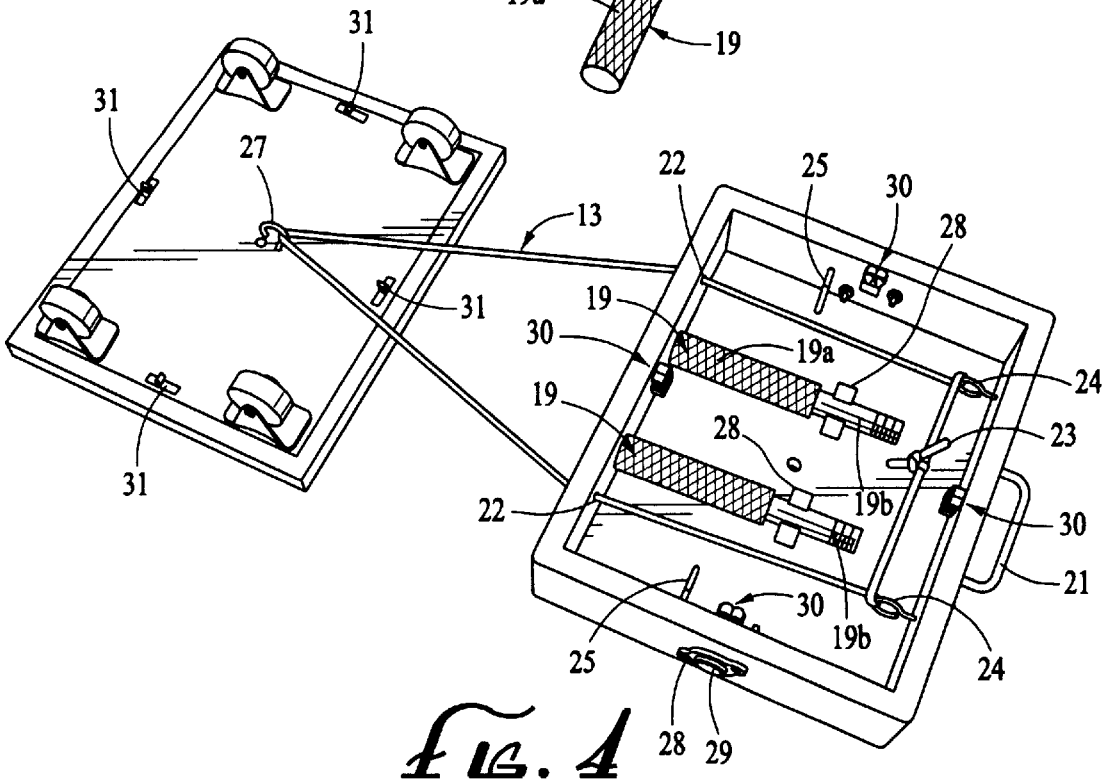
FIG. 4 is a view similar to FIG. 3 with the platforms separated, the resistance band adjusted for greater length and reduced tension, and the stub handles stored in the box.

As shown in FIGS. 3 and 4, the resistance element 13 of the presently preferred embodiment is a single elastic band that is anchored in the box 11 and connectable to the movable platform 12 by an external run that lies along one side of the box, the left-hand side as viewed in FIGS. 3 and 4, when the band is disconnected. In FIG. 3, it can be seen that the resistance band passes through two holes 22 in that one side and is joined at its ends by a knot 23. For adjustable tension and variable external length, the band is looped around a plurality of fasteners in the box that take up excess slack or length of the band but permit release of the length for outside use. While different arrangements may be used, herein two screw eyes 24 are spaced apart along the side of the box opposite the entry holes 21 and two screw hooks 25 are secured to the lateral sides of the box in the central portions of these sides, herein being somewhat closer to the side opposite the screw eyes. The resistance band passes through both screw eyes and has a U-shaped portion that is caught in the hooks to form the H-shaped overall configuration shown in FIG. 3. This applies relatively high tension to the band when the platforms are together, as shown and holds excess band length inside the box.

Outside the box 11, the resistance band will lie tightly against the box between the holes 22 until it is engaged with the movable platform. This is accomplished by stretching the band away from the box and looping it around an easily releasable connector 27 on the underside of the movable platform. This preferably is a screw hook that opens away from the box, for secure holding of the band during exercising. For less tension and a greater permitted range of separation of the movable and stationary platforms 12 and 20, the band can be released from the hooks 25 on the lateral sides and permitted to assume the condition shown in FIG. 4. The tension in the band still will hold the platforms together but with substantially less force.

The stub handles 19 normally are stored in the box 11 in the manner shown in FIG. 4, in two spring clips 28 that are suitably secured to the inside of the top wall 20 herein generally in the central portion of the box. The handles are removable for use in some exercises that call for the user to move the movable platform with his or her bands. For this purpose, each handle has a grip portion 19*a* that is shown as a knurled plastic sleeve for secure and comfortable engagement with a user's hands, and a stem 19*b* that has a threaded end, the stems being snap-fitted into the clips in the box, as shown in FIG. 4.

Attached to the outer sides of the lateral sidewalls of the box are two fittings 28 with threaded sockets 29 for tightly receiving the threaded ends of the stub handles 19, as shown in FIG. 3. These handles are parallel to the axes 15 of rotation of the wheels 14 so that back-and-forth forces on the handles will roll the movable platform 12 correspondingly.

Suitable latches are provided to hold the movable platform securely but releasably in place on the box 11. As shown in FIGS. 3 and 4, the illustrative latches comprise cabinet-type catches 30 that are placed inside the four sides of the box, attached to the sides by screw fasteners (not shown), each having two spring-loaded rollers that can be spread apart, and strikes 31 that have enlarged free end portions that are positioned to engage the rollers of the catches, spread them apart, and then be trapped by the rollers in latched positions. Such latches, which are conventional in construction, permit the cover 12 to be pressed into the closed position, held securely in place for portability, and released simply by pulling the movable platform 12 away from the box 11. Other latches may be used for these purposes, the illustrative latches being one suitable means for holding the cover releasably in place in the condition shown in FIG. 1.

Figure 5:
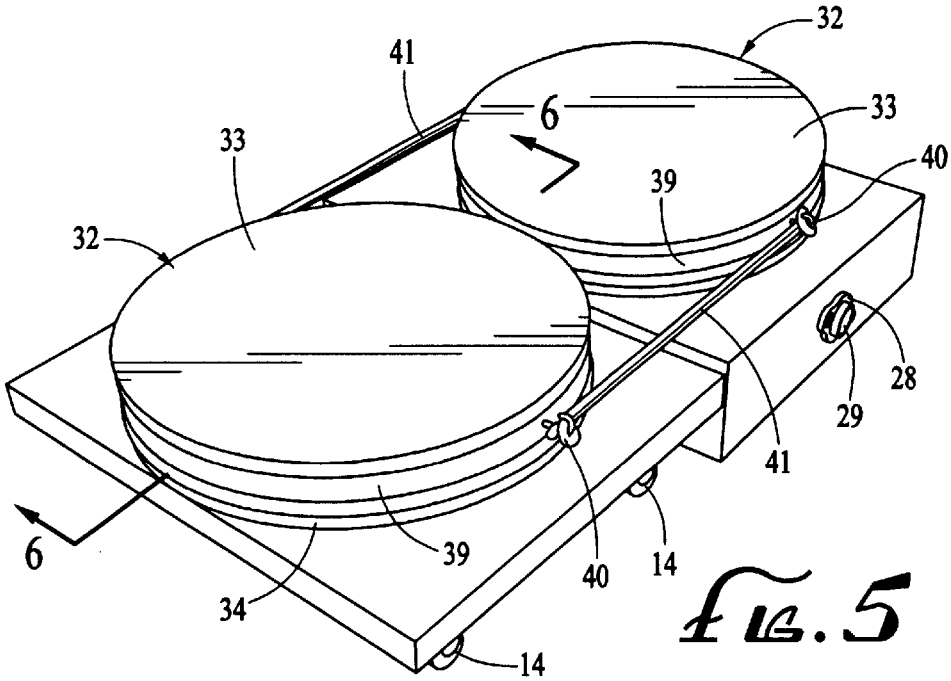
FIG. 5 is a top perspective view of the basic device as shown in FIG. 4 with the platforms together, accessory rotary disk assemblies mounted on the platforms, and removable connector bands in place for closed-chain exercises.
Figure 6:
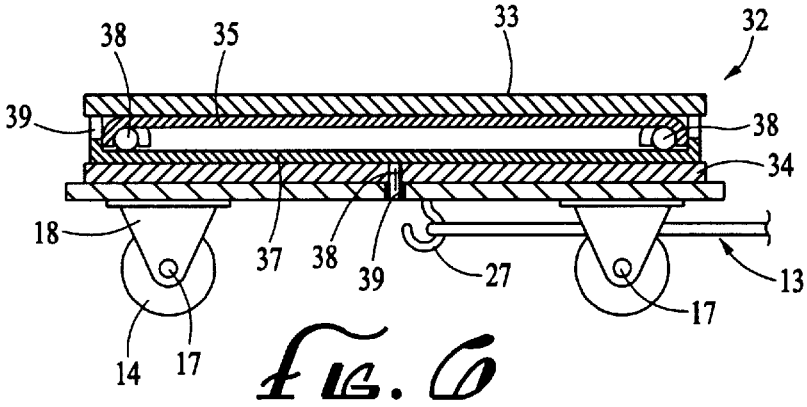
FIG. 6 is an enlarged fragmentary cross-sectioned view taken along line 6—6 of FIG. 5.

Shown in FIGS. 5 and 6 are two optional disk assemblies, each generally indicated by the number 32, that are usable with the basic exercise device of FIGS. 1 to 4 to provide additional novel and important capabilities for the basic device. These disk assemblies, which are not intended to be carried in the basic device, are mountable on the tops of the two platforms 12 and 20 to provide rotary platforms for supporting the user's body (hands or feet) for rotational exercises. As can be seen in FIG. 6, each disk assembly 32 has a circular top wall 33 and a concentric circular bottom wall 34 and is joined together by a ball bearing assembly comprising a top race 35 on the top wall, a bottom race 37 on the bottom wall, and a series of anti-friction ball bearings 38 rolling between these races so that the top wall turns freely relative to the bottom wall. A depending cylindrical flange 39 on the top wall covers the outside of the bearing.

The bottom wall 34 of each disk assembly 32 has a central mounting pin 38 on its underside that fits into a hole 39 in the top wall of the associated platform to secure the disk assembly removably to that platform. The pin 38 may be secured in the disk assembly with a tight gripping fit and received in the platform with a loose fit, so as to remain securely attached to the disk assembly when it is removed from the platform. Preferably, the disk assemblies are dimensioned to fit within the smaller dimension of the rectangular platforms as shown in FIGS. 5 and 6.

As shown in FIG. 5, each of the disk assemblies 32 has two connectors 40 that are carried on the flange 39 of the top wall 33, at diametrically opposed points, so that removable connector bands 41 maybe connected between the movable top walls of the assemblies. The connectors 40 herein are screw hooks and the bands 41 have knotted ends for quick and easy attachment and removal. When attached, these bands tend to hold the disks in the positions shown in FIG. 5 and to tie the disks together for rotation in each direction in what is known as closed-chain exercises, in which the bands assist in rotation of the disks together as the user exercises, providing incidental resistance to rotation only when the disks have turned substantial angular distances from the starting positions and also resisting spreading of the disk assemblies as the platforms are separated. This is used for early educational stages of a user's exercise program and is less difficult than open-chain exercises with the bands removed. Such open-chain exercises are more difficult and advanced, and are used for enhanced coordination and development. It will be seen that the two platforms 11 and 12 initially form, in practical effect, a single platform when stationary and side by side, and that rotational exercises may be performed without moving either component of the composite platform.

A number of representative exercises using the exercise device 10 of the present invention, some with the optional disk assemblies 32, are shown diagrammatically in FIGS. 7A through 14C. In these views, a user 42 is shown in changed positions that illustrate the repetitive movements of each exercise, some of which involve use of a wall or other anchor, indicated schematically by the reference number 43, and a flexible elastic "pull" member 44. General considerations in use of the device 10 in these exercises are care in establishing range of motion and loading, using lighter loads and shorter ranges before progressing; care in establishing and maintaining the proper postures, preferably under direction of a skilled trainer, including perineal contraction (belly button in and up, tail bone down) and lifting the chest while pulling the shoulders down and back; and proper breathing rate and rhythm. It is recommended that the user's eyes should be fixed on a relevant point or points in space, generally in a direction at ninety degrees to the line of the spine or the horizon. Individual detailed directions should be provided for each exercise.

Figure 7A:
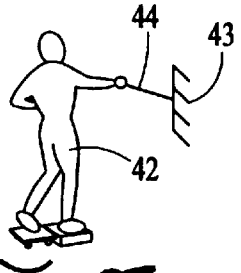
Figure 7B:
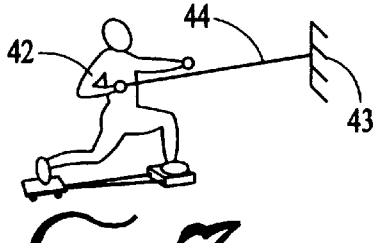

Shown in FIGS. 7A and 7B are the two illustrative positions for an exercise entitled "Striking Reverse Lunge Pulling," which is begun with the user standing on the side-by-side platforms and facing the anchor and holding the pull in an extended right hand, with the movable platform on the left side of the stationary platform, away from the anchor. The user lunges into the position shown in FIG. 7B, extending the leg on the movable platform against the resistance of the band 13 while pulling the right hand back and extending the left hand, and then reverses the movement to the starting position. This exercise can be performed with the hands and feet reversed as well, as can the others to be described.

Figure 8A:
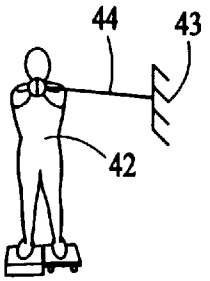
Figure 8B:
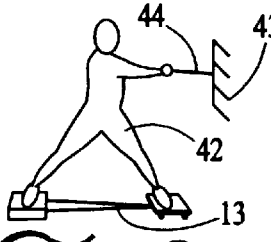
Figure 8C:
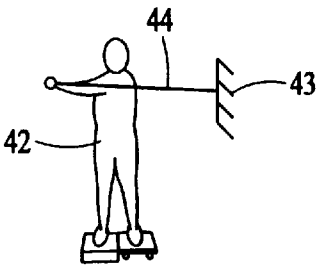

Next is the "Abduction Trunk Rotation" exercise in FIGS. 8A to 8C, in which the user begins by standing on the two platforms with their positions reversed, while facing at a ninety degree angle to the stretched pull, holding the latter in two extended and joined hands. Then the user extends the platforms against the resistance of the band 13 while swinging the hands toward the anchor (FIG. 8B), and then swings the hands back to an oppositely extended position while closing the platforms (FIG. 8C).

Figure 9A:
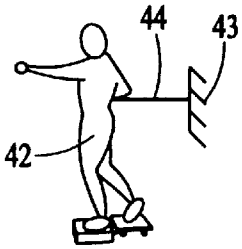
Figure 9B:
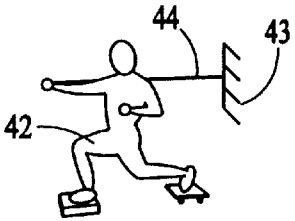

FIGS. 9A and 9B illustrate a "Striking Reverse Lunge Pulling" exercise in which the user begins facing away from the anchor with the pull gripped beside the waist in the right hand, left hand extended as shown (FIG. 9A), and lunges while spreading the movable platform toward the anchor and extending the left hand to the striking position (FIG. 9B). The user then returns to the starting position.

Figure 10A:
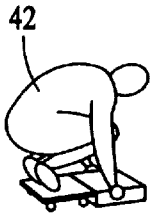
Figure 10B:
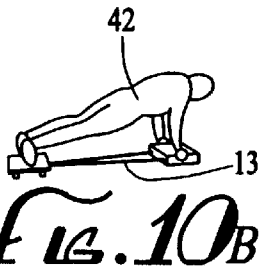
Figure 10C:
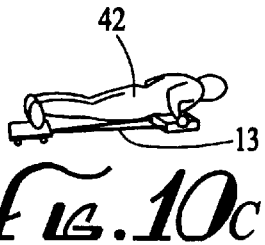

A very basic exercise is shown in FIGS. 10A to 10C, the "Squat-Thrust and Push-Up." Beginning with the feet on the movable platform and the hands on the stationary platform, here cupped over the lateral upper edges of the same (FIG. 10A), the user then extends the legs against the resistance of the band 13 to the "Push-Up" position (FIG. 10B), and drops to the lowered position in FIG. 10C. These movements then are reversed to return to the start position.

Figure 11A:
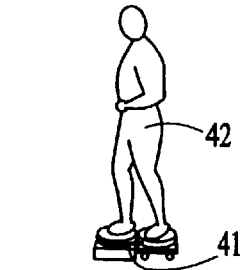
FIGS. 7 through 14 are diagrammatic sequence views illustrating some of the different basic exercises that can be executed with the device of the present invention, some with the accessory disks, as described in more detail hereinafter.
Figure 11B:
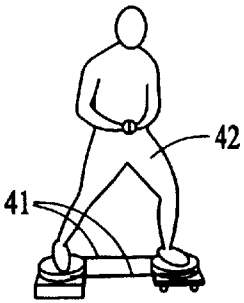
Figure 11C:
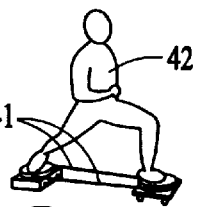

Use of the rotary disk assemblies 32 for combined rotational and reciprocating motions is illustrated in the remaining representative exercises, beginning with "Forward Lunge With Rotation" in FIGS. 11A to 11C. Starting with the body facing to the left on the closed platforms, with the disks tied together by the bands 41, the user rotates to the right while spreading the platforms (FIG. 11B), without the resistance of the band 13, and continues to turn to a right-facing "lunge" position with maximum platform extension (FIG. 11C). The user then retracts the extended left leg and rotates back to the start position. This is a closed-chain rotational exercise with platform reciprocation that is resisted by the resilient extension of the connecting bands 41, the band 13 being disconnected.

Figure 12A:
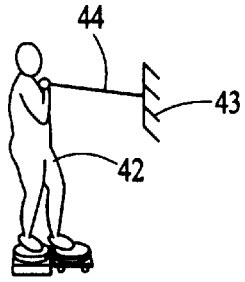
Figure 13A:
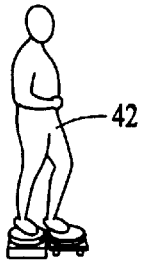
Figure 14A:
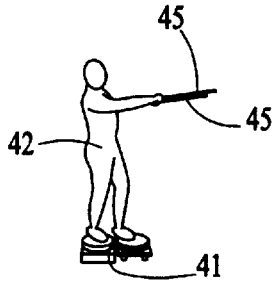
Figure 12B:
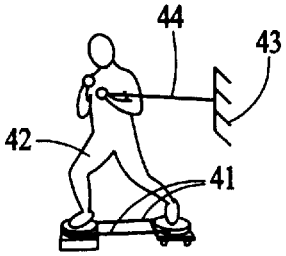
Figure 12C:
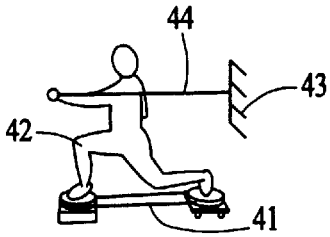

FIGS. 12A to 12C illustrate a "Rotating Reverse Lunge and Punch, " beginning facing the anchor with the platforms together, feet on the disk assemblies which are tied together, and rotating away from the anchor while extending the left leg toward the anchor (FIG. 12B) and then extending the left hand in a punching motion, against the resistance of the pull. FIGS. 13A to 13D show a basic "Rotating Reverse Lunge," beginning in a laterally facing position (FIG. 13A) with the platforms together, rotating about forty-five degrees to the front, and then continuing ninety degrees to the right while extending the left leg on the movable platform to the lunge position. This also is reversed to return to the start position.

Figure 13B:
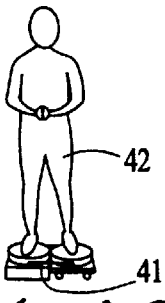
Figure 14B:
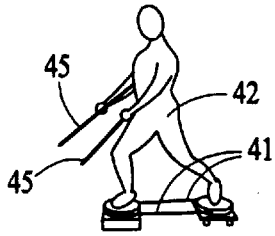
Figure 13C:
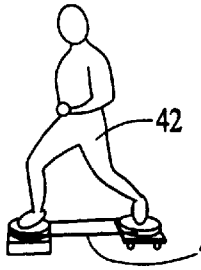
Figure 14C:
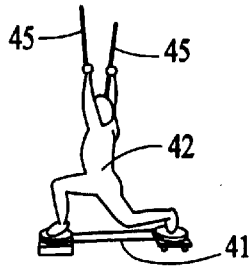
Figure 13D:
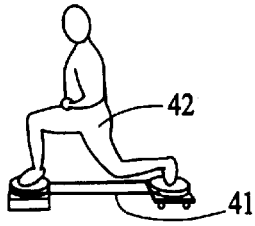

The last illustrative exercise is the "Rotating Reverse Lunge and Overhead Reach," using two rods 45 as accessories and performing the rotation and lunge motions of FIGS. 13B–13D while moving the rods from the extended starting position (FIG. 14A) to a downwardly-angled intermediate position (FIG. 14B) and finally to the upwardly-extended position shown in FIG. 14C. This adds the flexing and coordination of the arm movements to the body movements of the previous exercise.

The closed-chain rotational exercises in FIGS. 11 through 14 also may be performed in open-chain fashion with the bands 41 removed so that each disk assembly turns freely and independently of the other. Similarly, the resistance band 13 may be connected or disconnected, depending upon the desirability of resistance and the increased challenge of free and independent movement under the control of the user. Open-chain, independent movement is the most challenging exercise for the most beneficial effects for well-developed users.

From the foregoing, it will be seen that the exercise device of the invention is of compact and simple construction that is capable of use in a wide variety of exercises, some of which are illustrated herein, while being capable of being assembled in a briefcase-like unit for storage and portability. It also will be evident that, while one preferred embodiment has been shown and described, various modifications and changes may be made by those skilled in the art without departing from the spirit and scope of the invention.

I claim as my invention:

1. An exercise device comprising:

a base in the form of a box having an open side and a substantially flat side opposite said open side to form a stationary platform when the base is placed with the open side on a supporting surface, said box having sides for engaging the supporting surface in an inverted exercise position and one of said sides having two spaced holes;

a flat cover for said open side disposed in a storage position against said base and having wheels disposed inside said base, said cover forming a second platform that is movable from said storage position to an exercise position beside the base with said wheels on the supporting surface and with said one side beside the base;

an elongated elastic resistance band having a portion outside the base extending along said one side and extending into the base through said holes, said resistance band being secured to said base inside the latter base;

a connector on said movable platform for connection to said resistance band, said connector being secured to the underside of the movable platform to engage and hold the resistance band when the latter resistance band is stretched under the movable platform in the exercise position and to yieldably resist rolling of the movable platform away from the base;

at least one latch for holding the cover removably on the base in said storage position; and a handle attached to the outside of one of said sides for carrying of the exercise device like a briefcase.

2. An exercise device as defined in claim 1 wherein said base and said cover are generally rectangular in shape.

3. An exercise device as defined in claim 1 further including two stub handles, means for securing said handles in said base in storage positions, and fittings on opposite sides of said base for attaching the handles in laterally projecting positions for use in exercising.

4. An exercise device as defined in claim 1 wherein said base has two internal connectors opposite said holes and two additional connectors on lateral sides of the base, and said resistance band has two portions inside said base extending across the latter to said internal connectors and a U-shaped portion extending between said internal connectors and around said additional connectors, the latter being hooks permitting release of the U-shaped portion to adjust the available length of the band.

5. An exercise device as defined in claim 1 wherein said connector on the underside of the movable platform is a hook secured to the central portion of the underside.

6. An exercise device as defined in claim 1 wherein a plurality of said latches are provided between the cover and the base.

7. An exercise device as defined in claim 1 further including two rotary disk assemblies that are mountable on the cover and the base in the exercise positions.

8. An exercise device as defined in claim 7 wherein the tops of the cover and the base in the exercise positions are formed with central holes, and said disk assemblies have mounting pins that are removably received in the central holes.

9. An exercise device as defined in claim 7 wherein each disk assembly comprises a lower member attachable to one of the platforms, an upper member, and an anti-friction bearing between said members.

10. An exercise device as defined in claim 7 further including at least one detachable connector extending between said disk assemblies and connecting them for rotation together.

11. An exercise device as defined in claim 10 wherein two connectors are detachably connected to said disk assemblies at diametrically opposed points on each disk assembly, said connection being resiliently flexible elastic bands connecting the disks generally for rotation together and yieldably resisting separation of the disk assemblies.

12. An exercise device comprising:

a base in the form of a box having sidewalls around an open side of predetermined size and shape, and a flat outside surface forming an upper side when the open side is facing toward a supporting surface;

a resiliently flexible elastic resistance element secured to said base and having a portion extending along from one side of said sidewalls of said box base;

a movable platform having said predetermined size and shape to form a cover for the open side of said base and having wheels for movably supporting the platform on the supporting surface, said base being sized to receive said wheels when the platform is in place over said open side as a cover;

and a connection on said platform adapted to be joined to said portion of the resistance element when the base and the platform are in side-by-side relation, and to yieldably resist rolling of the platform away from the base;

said box having two exit holes in said one sidewall, and said resistance element is an elongated elastic band joined in said base to connections therein and having one portion of the band extending along the outer side on one sidewall of the base between the exit holes, said one portion being stretchable into engagement with said connection on said movable platform.

13. An exercise device comprising:

a base in the form of a box having sidewalls around an open side of predetermined size and shape, and a flat outside surface forming an upper side when the open side is facing toward a supporting surface;

a resiliently flexible elastic resistance element secured to said base and having a portion extending from one of said sidewalls of said base;

a movable platform having said predetermined size and shape to form a cover for the open side of said base and having wheels for movably supporting the platform on the supporting surface, said base being sized to receive said wheels when the platform is in place over said open side as a cover;

stub handles removably mountable on opposite sidewalls of said base to project laterally outwardly therefrom, and including means for securing said stub handles in said base for storage;

and a connection on said platform adapted to be joined to said portion of the resistance element when the base and the platform are in side-by-side relation, and to yieldably resist rolling of the platform away from the base.

14. An exercise device comprising:

a base having a flat upper surface forming a stationary platform and sides for holding the base in an exercise position with said upper surface above a supporting surface;

a movable platform adapted to be disposed beside said base on the supporting surface and having wheels rotatably mounted thereon for movement away from the base;

and a resiliently flexible elastic resistance band connected between said base and said movable platform for yieldably resisting movement of the movable platform away from said base;

said resistance element being an elongated elastic band secured to said base beneath said upper surface, extending to said movable platform and releasably secured to the underside of said movable platform and having;

ends joined beneath said upper surface and has two runs extending to said movable platform, and further including connectors on said base for holding said band releasably in an H-shaped configuration for adjustment of tension in the band.

15. An exercise device comprising:

a base having a flat upper surface forming a stationary platform and sides for holding the base in an exercise position with said upper surface above a supporting surface;

a movable platform adapted to be disposed beside said base on the supporting surface and having wheels rotatably mounted thereon for movement away from the base;

and a resiliently flexible elastic resistance band connected between said base and said movable platform for yieldably resisting movement of the movable platform away from said base;

and further including two rotational assemblies removably mounted on said platforms, said rotational assemblies having upper surfaces that are rotatable on said platforms for combined rotational and reciprocating motions.

16. An exercise device as defined in claim 15 wherein said rotational assemblies have first disks forming said upper surfaces, second disks forming lower elements mountable on said platforms, and anti-friction bearings between said-first and second disks.

17. An exercise device as defined in claim 15 further including at least one connector extending between said upper surfaces and joining the same for rotation together.

18. An exercise device as defined in claim 16 wherein two of said connectors are detachably connected to opposite sides of each of said upper surfaces, and said connectors are elastic bands.

19. An exercise device comprising:

a base having a flat upper surface forming a stationary platform and sides for holding the base in an exercise position with said upper surface above a supporting surface;

a movable platform adapted to be disposed beside said base on the supporting surface and having wheels rotatably mounted thereon for movement away from the base;

and a resiliently flexible elastic resistance band connected between said base and said movable platform for yieldably resisting movement of the movable platform away from said base;

said base being is an open-sided box and said movable platform is a cover for the open side of the box, said wheels being sized to fit within the box when the cover is in place over the open side, and further including at lease one latch for holding the cover releasably on the box and a carrying handle on one side of the box.

20. An exercise device comprising:

two rotational assemblies having upper rotary members, lower stationary members and bearings between said members supporting the upper members for rotation on the lower members;

platform means for supporting said rotary members in side-by-side rotation;

at least one connector extending between said upper rotary members;

and connecting means detachably connecting said connector to each of said upper rotary members to tie the same together for rotation.

21. An exercise device as defined in claim 20 wherein said connector is an elastic band and said connecting means comprise releasable connections on corresponding sides of said rotary members.

22. An exercise device as defined in claim 21 wherein a second elastic band is extended between said upper rotary members on the opposite corresponding sides thereof and said connecting means comprise second releasable connections for said second band.

23. An exercise device as defined in claim 21 wherein said platform means comprise a stationary platform and a movable platform to be disposed in side-by-side relation, said movable platform having wheels for movement away from the stationary platform.

* * * * *